US007669732B2

(12) United States Patent
Njaastad

(10) Patent No.: US 7,669,732 B2
(45) Date of Patent: Mar. 2, 2010

(54) CUP LID DISPENSER

(75) Inventor: David Njaastad, Palatine, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 401 days.

(21) Appl. No.: 11/585,611

(22) Filed: Oct. 24, 2006

(65) Prior Publication Data

US 2007/0090125 A1 Apr. 26, 2007

Related U.S. Application Data

(60) Provisional application No. 60/730,093, filed on Oct. 25, 2005.

(51) Int. Cl.
*B65G 59/00* (2006.01)

(52) U.S. Cl. ..... 221/255; 221/197; 221/256; 221/267; 221/294; 221/239

(58) Field of Classification Search ..... 221/309, 221/294, 267, 255, 239, 194
See application file for complete search history.

(56) References Cited

U.S. PATENT DOCUMENTS 4,295,580 A * 10/1981 Amberg ..... 221/268
4,643,334 A * 2/1987 Steele ..... 221/63
5,131,562 A * 7/1992 Brown ..... 221/41
5,845,791 A * 12/1998 Kawolics ..... 211/49.1
5,944,220 A * 8/1999 Garske et al. ..... 221/312 A
6,357,624 B1 * 3/2002 Brown ..... 221/312 A

* cited by examiner

*Primary Examiner*—Gene Crawford
*Assistant Examiner*—Timothy R Waggoner
(74) *Attorney, Agent, or Firm*—Pyle & Piontek, LLC

(57) ABSTRACT

A cup lid dispenser is characterized by a cylindrical housing for containing a stack of relatively flexible cup lids in vertical orientation with a lip of the bottommost lid supported at points around its circumference on a plurality of shelves within and around a base of the dispenser at a lower end of the housing. The base has a forward opening that exposes just a front portion of the lip of only the bottommost lid of the stack for being gripped by a user. To dispense the bottommost lid, a user grips the exposed lip and pulls the lid downward to flex it away from the overlying stack and forward to move it off of the shelves and release it from the overlying stack of lids for downward movement into an underlying pocket in the base, with continued forward pulling of the lid then moving it through and out of a forward dispense opening from the base. Upon dispense of the bottommost lid, the stack gravitationally moves downward and the lip of the next lid up moves into the support shelves and into position for dispensing.

6 Claims, 18 Drawing Sheets

| | | | |
|---|---|---|---|
| S | L | L | X |
| S | X | L | L |
| S | L | X | L |
| L | S | L | X |
| L | S | X | L |
| L | L | S | X |
| L | L | X | S |
| L | X | L | S |
| L | X | S | L |
| X | L | L | S |
| X | L | S | L |
| X | S | L | L |

Legend
S – Small/Medium Beverage Lid Dispenser
L – Large Beverage Lid Dispenser
X – Extra Large Beverage Lid Dispenser

Fig. 16

CUP LID DISPENSER

This application claims benefit of provisional application Ser. No. 60/730,093, filed Oct. 25, 2005.

FIELD OF THE INVENTION

The present invention generally relates to cup lid dispensers, and in particular to a manual cup lid dispenser that prevents more than one lid at a time from being dispensed.

BACKGROUND OF THE INVENTION

Beverages such as soft drinks, coffee, hot soups and the like are often dispensed into plastic and paper cups, onto which lids may be applied for safety and cleanliness. However, the sanitation of cup lids is often defeated in the process of placing the lids on cups, since the lids are commonly dispensed from open containers or free standing stacks, as a result of which they may be and often are dropped on the floor, scattered about on tables and handled by several people before being placed on a cup and delivered to a customer. Also, when the lids are in a free standing stack, they can become stuck together, making it necessary to use both hands to separate a single lid from the stack, which necessitates the expenditure of unnecessary time in manually separating and dispensing lids, and thereby hinders food service efficiency.

In an attempt to overcome the problems of free standing stacks of lids and placement of lids on open surfaces, and excessive handling of lids, vertical cylinders or other upright containers have been developed for holding and dispensing cup lids. While such dispensing cylinders are convenient, problems arises in dispensing lids from the cylinders, since a stack of substantially interlocked lids impedes horizontal movement and removal of individual lids from the bottom of the stack, such that lids can only be conveniently removed from the bottom of the stack with downward motion of the bottom lid, but this motion is generally difficult to achieve with prior designs of vertically standing cup lid containers. Consequently, many current designs of lid dispensers provide for dispensing of lids from the top of a stack of lids in a vertically standing dispenser. A problem with the design is that the dispensers are refilled from the top, and whenever a dispenser is refilled before it is empty, cup lids toward the bottom of the dispenser that remain from previous refill(s) experience an extended residence time in the dispense and their sanitation is compromised, ultimately resulting in disposal of the lids.

There is a need for an economical, easy to use, space saving cup lid dispenser that will handle lids in a sanitary fashion and provide for convenient manual dispensing of lids one at a time from the bottom of a stack of lids.

OBJECTS OF THE INVENTION

An object of the present invention is to provide a cup lid dispenser that is configured to reliably dispense just one cup lid at a time from a bottom of the dispenser.

Another object is to provide such a cup lid dispenser in which a user's hand is guided to grip just the bottommost cup lid in the dispenser for removal of the lid from the dispenser.

A further object is to provide such a dispenser in which a user is prevented from gripping and removing any cup lid in the dispenser other than the bottommost lid.

Yet another object is to provide such a dispenser that may readily and conveniently be removably mounted on a beverage dispenser or a wall.

SUMMARY OF THE INVENTION

In accordance with the present invention, a cup lid dispenser comprises a cup lid containment tube for holding a stack of cup lids; and a base at a lower end of the containment tube for receiving a lower end of a stack of lids in the containment tube. The base has a plurality of cup lid supports for supporting a circumferential periphery of a bottommost lid of the stack, and a bottom wall extends from a rearward side of the base partially toward a forward side of the base and below and spaced from the supports and defines with the supports a cup lid receiving pocket. The base also has a cup lid dispensing opening at a forward side of the base and opening to the cup lid receiving pocket, and a user guide at the forward side of the base exposes a forward portion of just the bottommost lid of the stack for gripping by a user, but blocks user access to lids of the stack above the bottommost lid, whereby a user can dispense the bottommost cup lid of the stack by gripping the exposed forward portion of the bottommost lid and pulling the lid downward off of the cup lid supports and into the lid receiving pocket, and then forward through the cup lid dispensing opening and out of the cup lid dispenser.

In a preferred embodiment of the cup lid dispenser, the containment tube and base are generally cylindrical, the containment tube has an open upper end into which cup lids can be introduced to fill and refill the cup lid dispenser, and a removable cap is provided for closing the open upper end of the containment tube. The cup lid supports of the base are arcuately spaced around an interior circumference of the base and lie in a common plane that extends generally perpendicular to a longitudinal axis of the containment tube. Also, the base bottom wall extends forward from a lower rearward side of the base, is joined to the base rearward side about an arcuate extent that is less than half the circumference of the base, extends in a plane generally perpendicular to a longitudinal axis of the containment tube, and extends forward from the base rearward side in a generally "bell curve" configuration toward, but short of, the base forward side to define a generally crescent-shaped opening from a bottom of the base. The cup lid dispensing opening at the forward side of the base is contiguous with the crescent-shaped opening from the bottom of the base and the two openings together define a cup lid outlet opening from the cup lid receiving pocket.

Advantageously, the user guide comprises a downwardly extending portion of the base that terminates at its lowermost end at the cup lid dispensing opening and below the bottommost cup lid of the stack, and that has a medial upwardly extending arcuate opening that exposes just a forward portion of just the bottommost cup lid for being gripped by a user, the user guide also having a portion for guiding one of a user's thumb and index finger to the exposed forward portion of the bottommost cup lid for gripping and removal of the bottommost cup lid from the dispenser.

Arrangements of the cup lid dispensers are contemplated in which a plurality of cup lid dispensers are removably mounted on a beverage dispenser in a plurality of different arrangements; in which a plurality of cup lid dispensers are supported in an annular array on a turntable that is mounted for rotation on a flat surface, whereby the annular array of cup lid dispensers can be rotated on the turntable by a user to bring a selected one of the cup lid dispensers to the user for removal of a cup lid therefrom; and in which a plurality of cup lid dispensers are removably mounted on a wall in a plurality of different arrangements.

The invention also contemplates a method of dispensing cup lids, which comprises the steps of loading a stack of cup lids into a cup lid containment tube having a cup lid dispensing base at its lower end for receiving a lower end of the stack of cup lids; supporting a circumferential lip of the bottommost cup lid of the stack on a plurality of supports within the base; forming in the base a cup lid receiving pocket beneath the bottommost lid; defining a cup lid dispensing opening at a forward side of the base as an extension of the cup lid receiving pocket; exposing at the forward side of the base just a forward portion of the lip of just the bottommost cup lid of the stack for gripping by a user; and removing the bottommost cup lid of the stack from the overlying cup lids by gripping the exposed forward portion of its lip, pulling the gripped bottommost cup lid downward off of the supports and into the cup lid receiving pocket, and then pulling the bottommost cup lid forward through the cup lid dispensing opening.

In a preferred practice of the method, the step of forming in the base a cup lid receiving pocket comprises the step of providing a bottom wall of the base that extends from a rearward side of the base partially toward the base forward side and that is spaced from and below the bottommost cup lid of the stack to define the cup lid receiving pocket between the supported bottommost lid of the stack and the bottom wall; and the exposing step comprises providing a generally vertically extending user guide at the forward side of the base, and configuring the user guide to expose just the forward portion of the lip of just the bottommost cup lid of the stack for gripping by a user and to guide one of a user's thumb and index finger to the exposed forward portion of the lip for being gripped by the user. In addition, included are the steps of introducing cup lids into an open upper end of the containment tube to fill the containment tube with cup lids, and placing a removable cap on the open upper end of the containment tube. The supporting step can comprise supporting the circumferential lip of the bottommost cup lid of the stack on a plurality of supports arcuately spaced around an interior circumference of the base and lying in a common plane that extends generally perpendicular to a longitudinal axis of the containment tube, and the step of providing the base bottom wall provides a bottom wall that extends forward from a lower rearward side of the base, is joined to the base rearward side about an arcuate extent that is less than half the circumference of the base, extends in a plane generally perpendicular to a longitudinal axis of the cup lid containment tube, and extends forward from its juncture with the base in a generally "bell curve" configuration toward, but short of, the base forward side to define a generally crescent-shaped opening from a bottom of the base. Further, the step of defining a cup lid dispensing opening defines the cup lid dispensing opening at the forward side of the base to be contiguous with the crescent-shaped opening from the bottom of the base, so that the two openings together define a cup lid outlet opening from the cup lid receiving pocket.

The cup lid containment tube and cup lid dispensing base together comprise a cup lid dispenser, and in various contemplated practices of the method a plurality of cup lid dispensers are removably mounted on a beverage dispenser in selected ones of a plurality of different mounting arrangements; a plurality of cup lid dispensers are supported by their bases in an annular array on a turntable, with upper ends of the cup lid dispensers being connected and with the turntable being mounted for rotation on a surface, so that the array of cup lid dispensers can be rotated to bring a selected one of the cup lid dispensers into position for removal of a cup lid therefrom; and a plurality of cup lid dispensers are removably mounted on a wall in selected ones of a plurality of different mounting arrangements.

The foregoing and other objects, advantages and features of the invention will become apparent upon a consideration of the following detailed description, when taken in conjunction with the accompanying drawings.

BRIEF DESCRIPTION OF THE DRAWINGS

FIG. 16 is a table showing various possible combinations and arrangements of four cup lid dispensers on a beverage dispenser.

DETAILED DESCRIPTION

Figure 1:
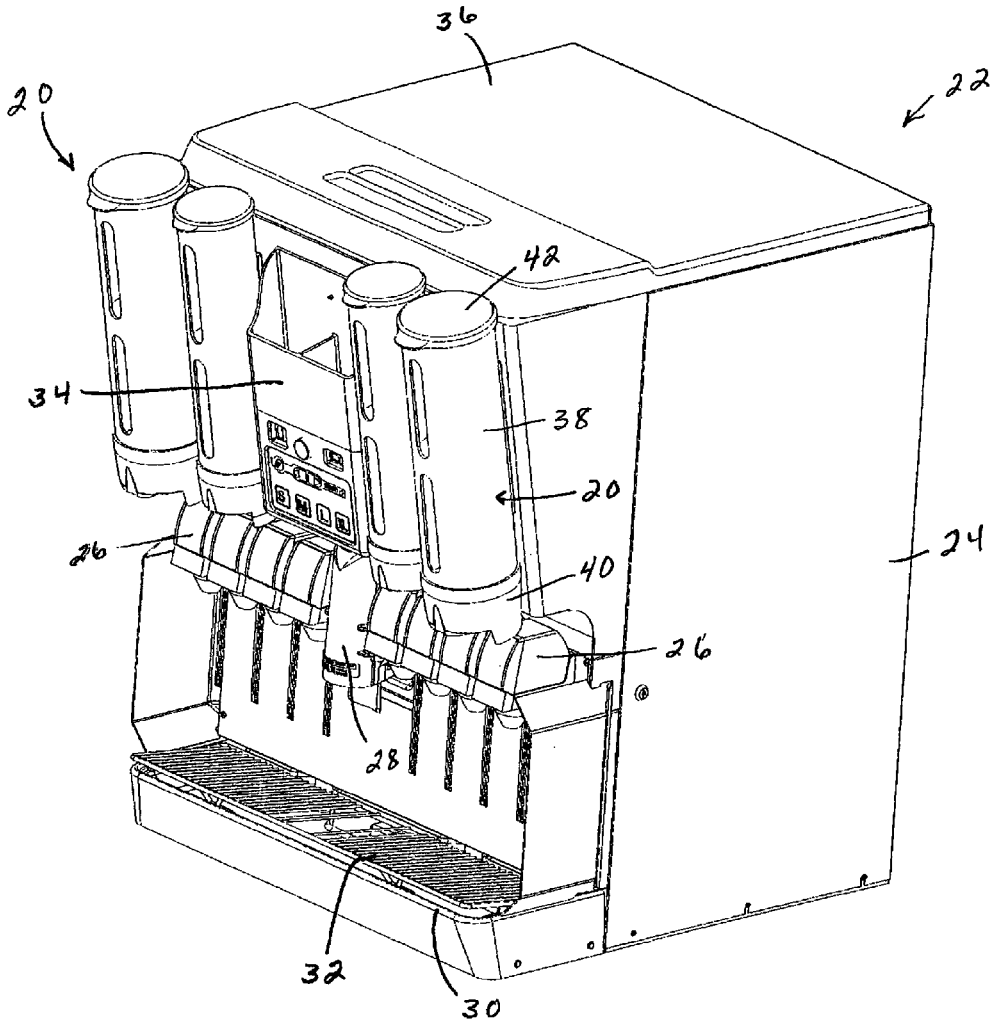
FIG. 1 is a view of an ice and beverage dispenser on a front of which are mounted four cup lid dispensers embodying the teachings of the invention.
Figure 2:
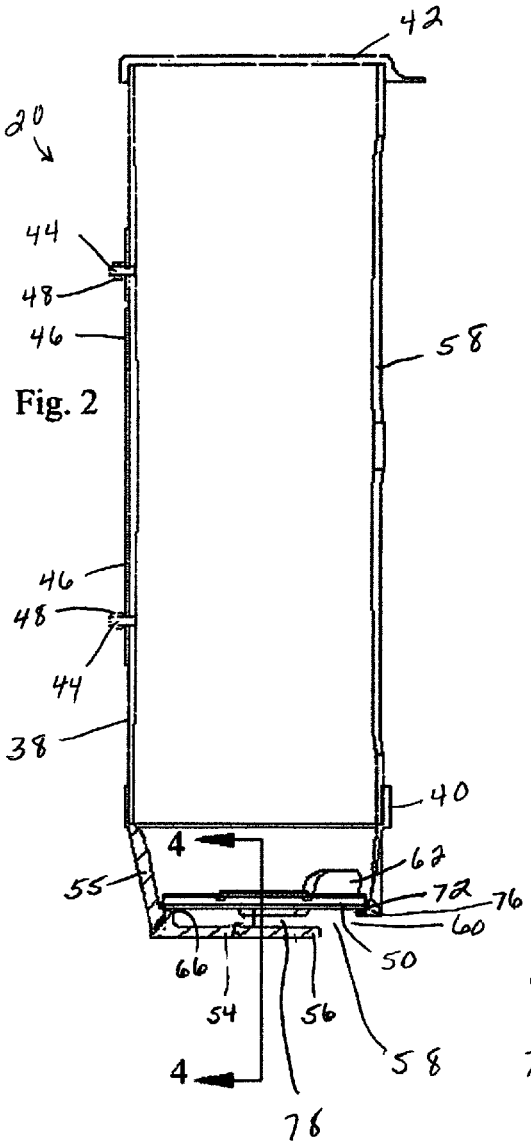
FIG. 2 is a cross-sectional side elevation view of a cup lid dispenser according to the invention.
Figure 3:
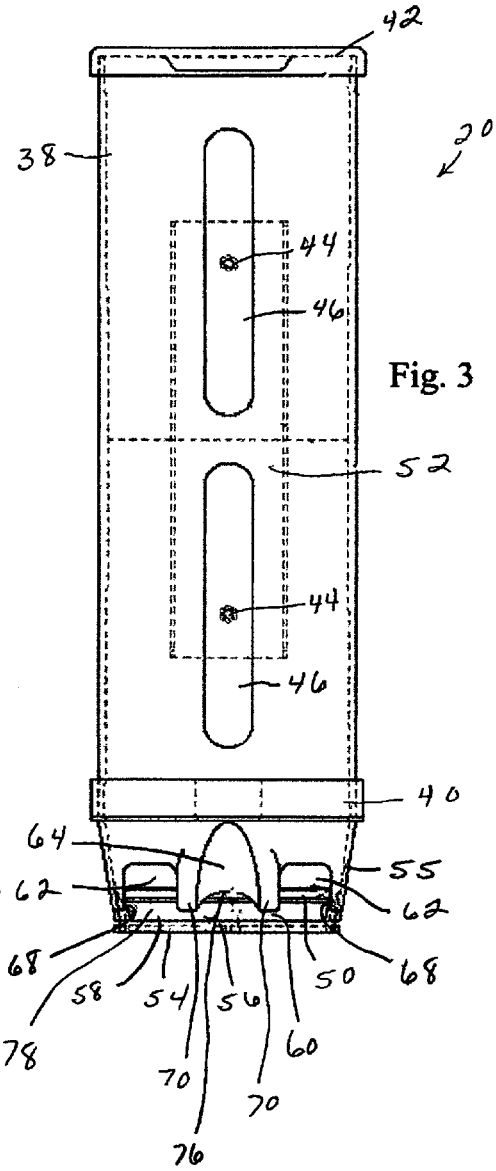
FIG. 3 is a front elevation view of the cup lid dispenser.
Figure 4:
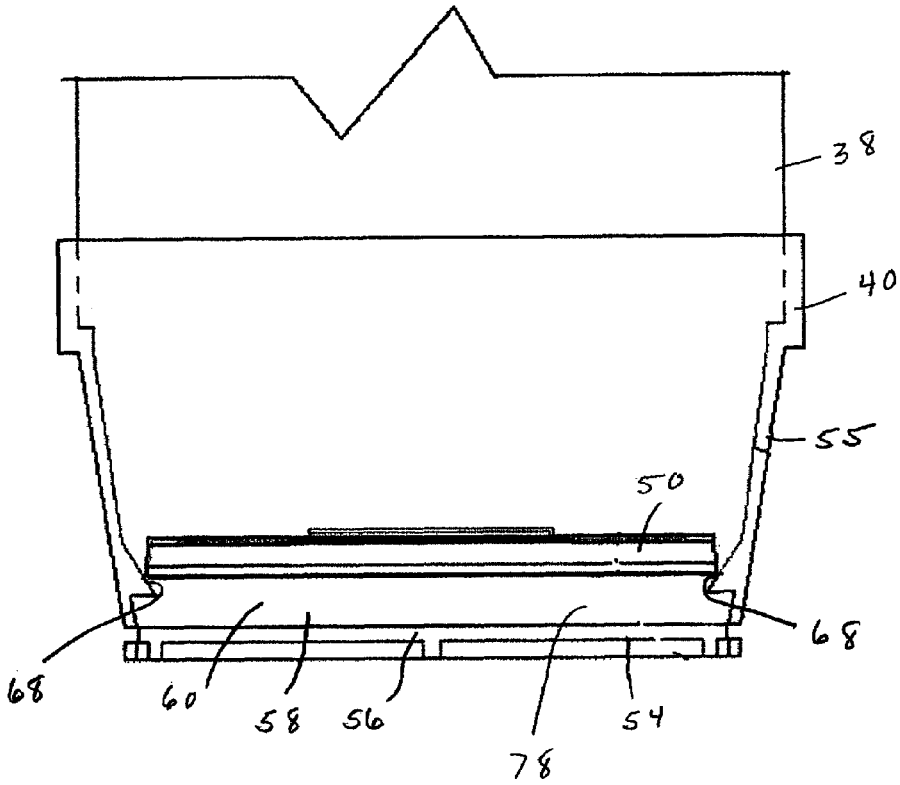
FIG. 4 is a cross-sectional view taken along the lines 4-4 of FIG. 2.
Figure 5:
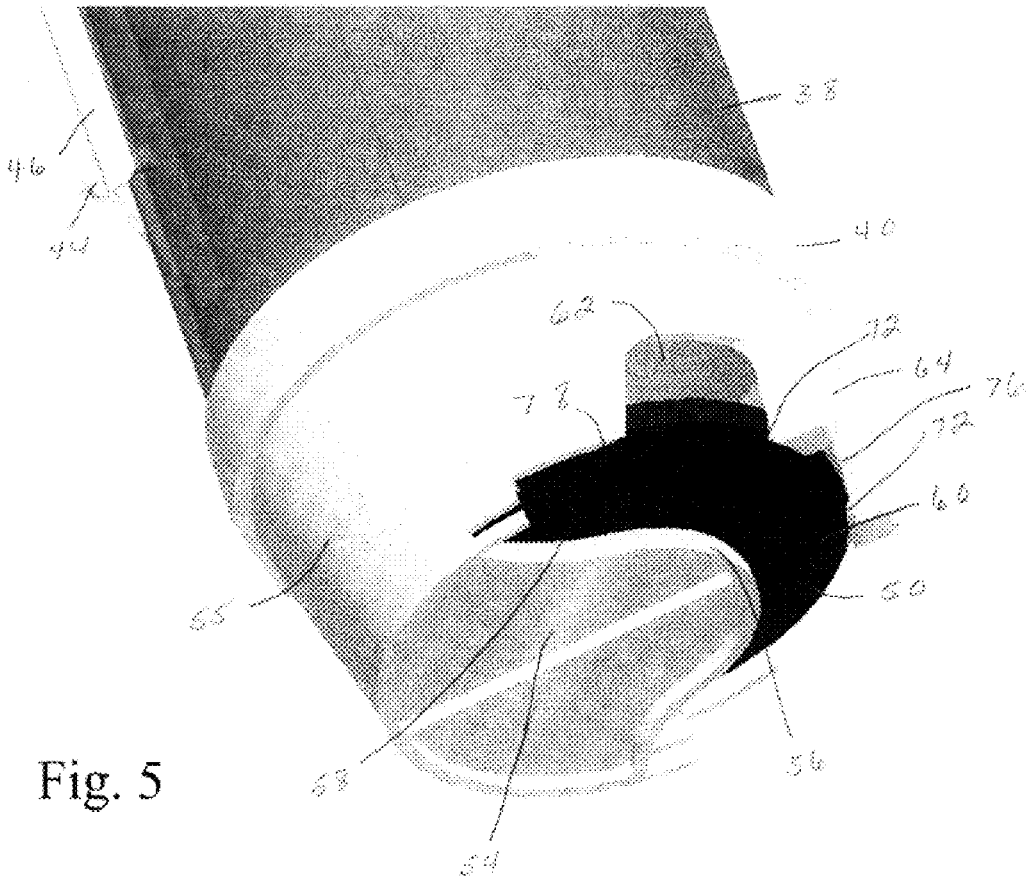
FIG. 5 is a perspective view of a lower portion of the cup lid dispenser.
Figure 6:
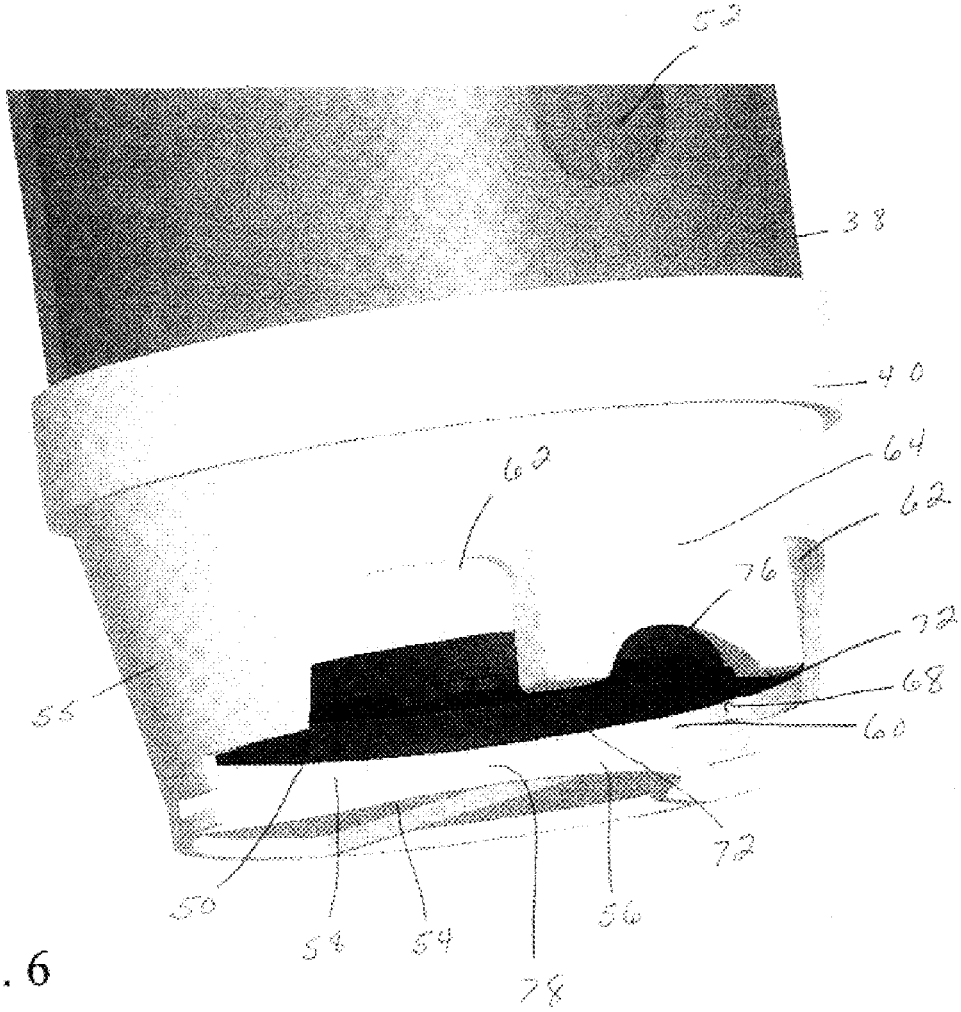
FIG. 6 is another perspective view of the lower portion of the dispenser.
Figure 7:
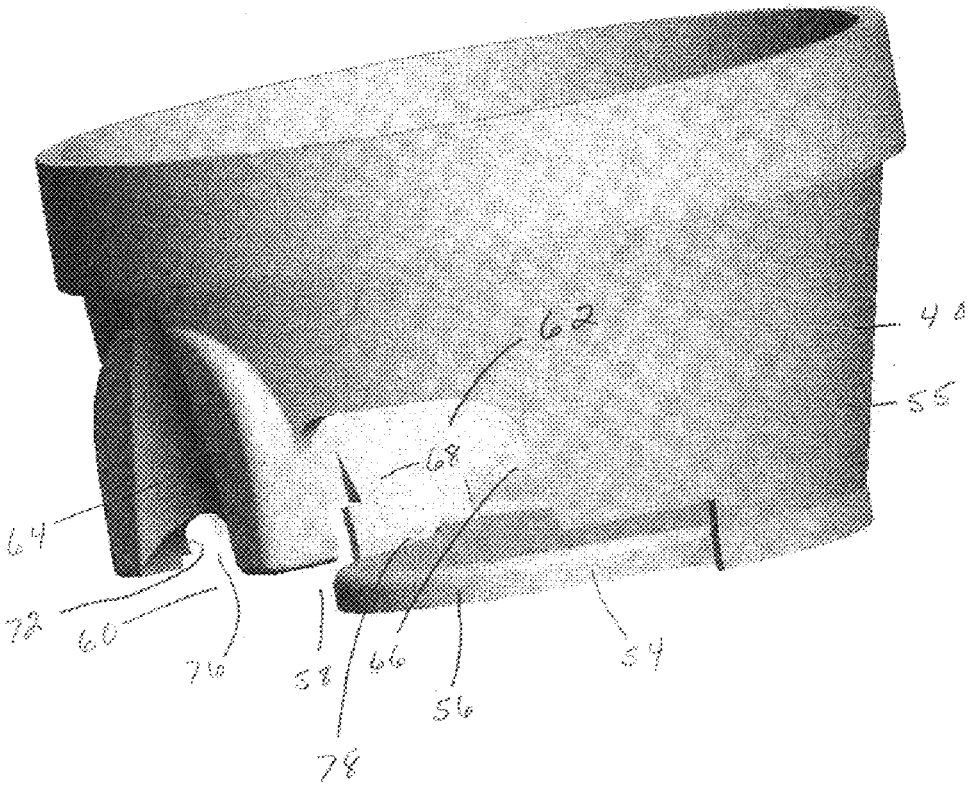
FIG. 7 is a perspective view of a lower base of the dispenser.
Figure 8:
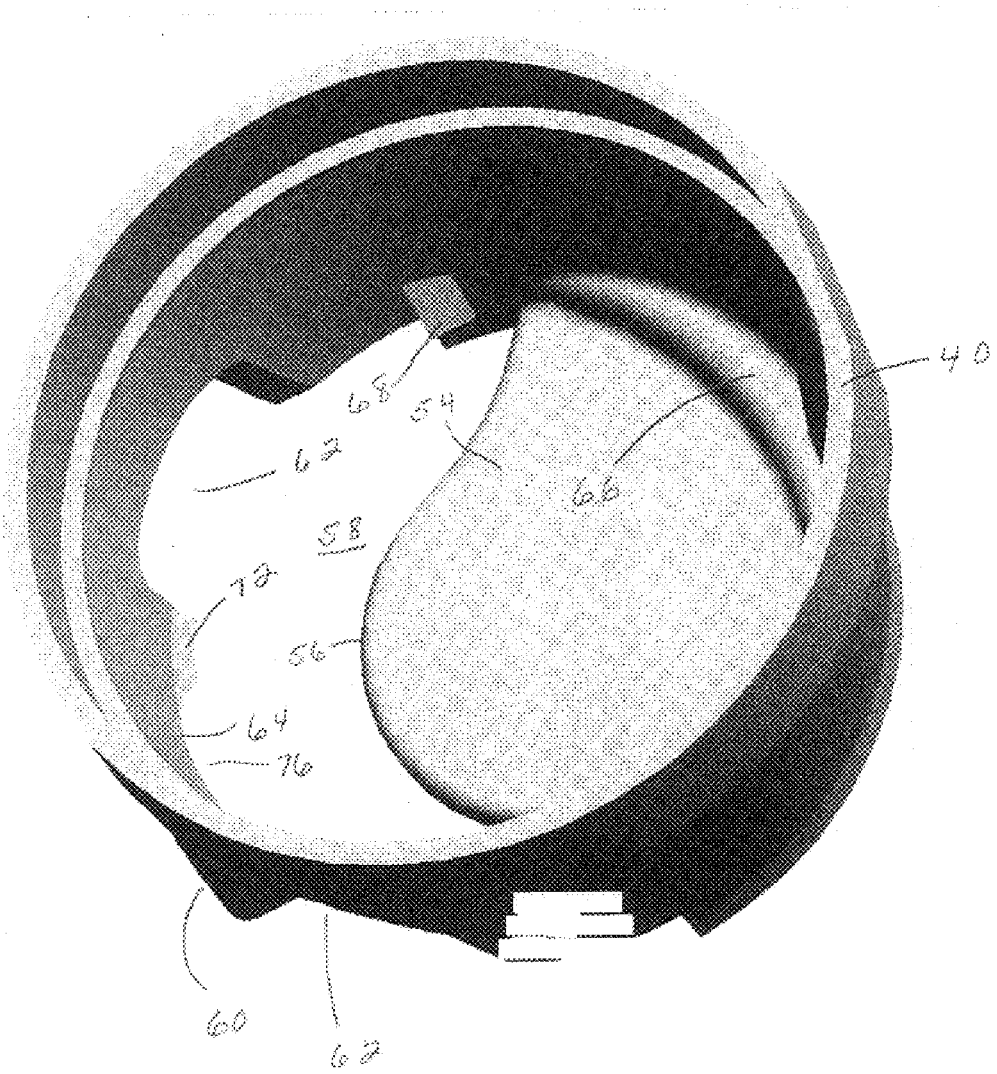
FIG. 8 is a perspective view of the interior of the base of the dispenser.

FIG. 1 illustrates one possible environment in which cup lid dispensers according to the invention may advantageously be used. As shown, four cup lid dispensers, indicated generally at 20, are on a front surface of an ice and beverage dispensing machine, indicated generally at 22. The cup lid dispensers have identical construction and differ only in their diameters and, therefore, in the sizes of cup lids each is adapted to control and dispense. For example, the individual cup lid dispensers 20 may be appropriately sized to accommodate cup lids for small, medium, large and extra large beverages, and their placement on the front of the beverage dispenser facilitates their removal for convenient refilling and cleaning. As is customary, the beverage dispensing machine includes a housing 24 and is provided with a plurality of beverage dispensing valves 26 on a front of the housing on opposite sides of an ice dispensing chute 28, beneath which beverage valves and ice chute is a drip tray 30 having a grate 32 over its open upper end. The cup lid dispensers 20 are mounted to opposite sides of a beverage dispense control panel 34, on which may be provided various switches, such as individual push-button switches S, M, L and XL to respectively control dispensing of small, medium, large and extra large beverages. The control panel 34 may also include indicators to visually identify the state of operation of the machine, and a cover 36 on top of the housing 24 is removable to accommodate access to an internal ice retaining bin (not shown) for refilling the bin with ice.

With reference to FIGS. 2-8, each cup lid dispenser 20 is generally cylindrical and comprises four basic components: a cylindrical and normally vertically extending cup lid containment tube 38; a base 40 that fits on a lower end of the tube 38 and from which relatively flexible cup lids are dispensed; a cap 42 that may optionally be placed on an upper end of the cup lid containment tube 38; and a mounting assembly comprising a pair of mounting tabs 44 carried by brackets 46 attached to a side surface of the cylindrical lid containment tube. The base, containment tube and cap may be made of molded plastics material, and the base is glued to the bottom end of the tube and the cap is tethered to the upper end of the tube by any suitable means. The mounting tabs 44 extend generally radially out of and away from the containment tube 38 and are provided with enlarged outer ends adapted to be received in a conventional manner in enlarged openings to and at the upper ends of relatively narrower slots provided in mounting brackets on the front of the beverage dispenser 22, to thereby removably mount the cup lid dispenser on the front of the beverage dispenser, in a manner well understood in the art. Although the lid dispensers 20 are shown as mounted on the front surface of the beverage dispenser, the mounting arrangement accommodates their removal from the beverage dispenser for use in multiple applications or locations.

Each cup lid dispenser 20 holds a stack of cup lids 50 in vertical orientation, a lowermost cup lid of a stack being shown in position to be dispensed. The cup lids may be of a conventional well known type that have a circular top wall that may or may not be provided with vent holes and a slit area through which a straw may be extended, and a circumferential side wall comprising a circular lip that extends downward and outward from a circular periphery of the top wall, with a circular and upwardly extending recess being formed at the juncture of the top and side walls for receiving the upper end of a cup on which the lid is placed in order to releasably mount the lid on the cup. The lid dispenser is designed to be removed from the front of a merchandiser, such as the beverage dispenser 22, for ease of loading and reloading it with cup lids and to allow for convenient cleaning of both it and the merchandiser. The lid dispensers 20 can be arranged in many different configurations, such as is shown where four lid dispensers are mounted on the front of the beverage dispenser. To load the lid dispenser 20 with cup lids when it is empty or almost empty, it may be removed from the beverage dispenser 22 by lifting and pulling it away from the dispenser. With the cap 42 removed, a fresh sleeve of lids, i.e., a stack of lids contained in plastic wrap, is then inserted into the containment tube 38. With the containment tube standing upright, the plastic wrap is then pulled from around the stack of lids, leaving the lids behind and within the containment tube, whereupon the cap 42 is replaced and the dispenser 20 is remounted on the front of the beverage dispenser. If the cup lids are not provided in a plastic sleeve, a stack of the lids may be placed on a surface with the lid bottoms facing up, and with the lid dispenser turned upside down it is inserted or extended over and around the stack so that the cup lids are received within the containment tube 38, whereupon a user places his hand over the open end of the lid dispenser containment tube to capture the lids in the tube while turning the lid dispenser right side up. To prevent the cup lids from rotating in the containment tube when the lids are loaded, it is desirable that the lids be loaded while they are still within their plastic shipping sleeve, and that the sleeve thereafter be removed from around the lids after the lids are positioned in the containment tube. Should some of the lids in the stack lose their proper orientation within the containment tube, a slot 58 in the front of the containment tube provides access to the lids to allow their reorientation by an operator. The slot also advantageously provides a means by which the height of the stack of cup lids in the dispenser may readily be visually determined, so that the dispenser can be refilled before its supply of cup lids is exhausted.

The base 40 of the cup lid dispenser 20 is uniquely configured to accommodate gripping and dispensing of just one lid at a time from the bottom of the stack of lids within the containment tube 38, without considerable effort being required to remove the lid and without resulting in removal or displacement of one or more overlying lids. The containment tube and the upper end of the base 40 have diameters greater than the diameters of the lids, and the base has a generally frusto-conical shaped lower portion that tapers radially inward in the downward direction to a lower and smaller diameter bottom end, which frusto-conical portion serves to properly orient the bottom of the stack of lids for dispensing. The base 40 may be a unitary molded structure and has at its bottom end a bottom wall or protruding lip 54 extending generally perpendicular to a longitudinal axis of the dispenser 20. The protruding lip 54 extends forward from a bottom rearward side of a base side wall 55 and is joined to the side wall about an arcuate extent that is less than half the circumference of the base side wall. Forward from its juncture with the base side wall, a forward portion 56 of the protruding lip 54 continues to extend forward in a generally "bell curve" configuration to define a lower generally crescent-shaped opening 58 from the base 40, when viewed from the bottom of the base. The forward side of the base side wall 55 terminates at its lower end in spaced relationship forward from and above the protruding lip 54, about an arcuate extent that may be more than half the forward circumference of the side wall, thereby to define, along with the crescent-shaped opening 58, an arcuate forward facing cup lid dispensing opening 60 from the base 40. The lower forward side of the base side wall 55 has a pair of cup lid viewing openings 62 on opposite sides of a finger guide 64 that is formed by a recessed front area of the side wall that increases in depth and width from an upper end to a lower end that terminates at the cup lid dispensing opening 60.

Cup lid support means are provided within the lower interior of the cup lid dispenser base 40. The support means includes a cup lid support shelf or platform 66 that extends upward from the bottom wall or protruding lip 54 substantially along the extent of its juncture with the rearward side of the base side wall 55, is arcuate in configuration and has an increasing inner radius to opposite sides of its center. Forward from opposite forward ends of the shelf 66 and generally on opposite sides of the interior lower end of the side wall 55 are a pair of cup lid support shelves or platforms 68, and at the front of the base side wall, on the inner surfaces of a pair of downward depending ribs 70 on opposite sides of the finger guide 64, are a pair of forward lid support shelves or platforms 72. The cup lid support shelves 66, 68 and 72 together serve to support a lip of a bottommost cup lid 50 of a stack of lids at spaced locations around the lip and to orient the lid for being dispensed. The cup lid support surfaces of shelves 66, 68 and 72 lie in a common plane that extends generally perpendicular to a longitudinal axis of the cup lid dispenser 20.

When the cup lids are loaded in a stack in the cup lid dispenser 20, the weight of the overlying lids presses the lowermost lid against the cup lid support shelves 66, 68 and 72 to trap the lowermost lid 50 in a staging position. The finger locator 64 is configured to terminate at its lower end such that it exposes only a forward portion of the lip of just the lowermost lid within an opening 76 defined between the ribs 70 at the bottom of the finger locator, causing the lowermost lid to separate slightly from the overlying lid at the opening 76. To dispense the lowermost lid, and using the finger locator 64 as a guide for a thumb or index finger, an operator grips with his thumb and index finger the exposed lip of the lowermost relatively flexible cup lid and pulls it downward and forward, with the finger guide blocking access to overlying lids and preventing the operator from accidentally also gripping any overlying lids. As the lowermost lid 50 is pulled downward and forward, it first moves off of the support shelves 66, 68 and 72 and drops down into a pocket 78 defined in the base 40 above the protruding lip 54 and below the overlying stack of lids, whereupon continued pulling of the lid fully releases it from the overlying stack and removes it from the dispenser for being placed on a cup.

Figure 9A:
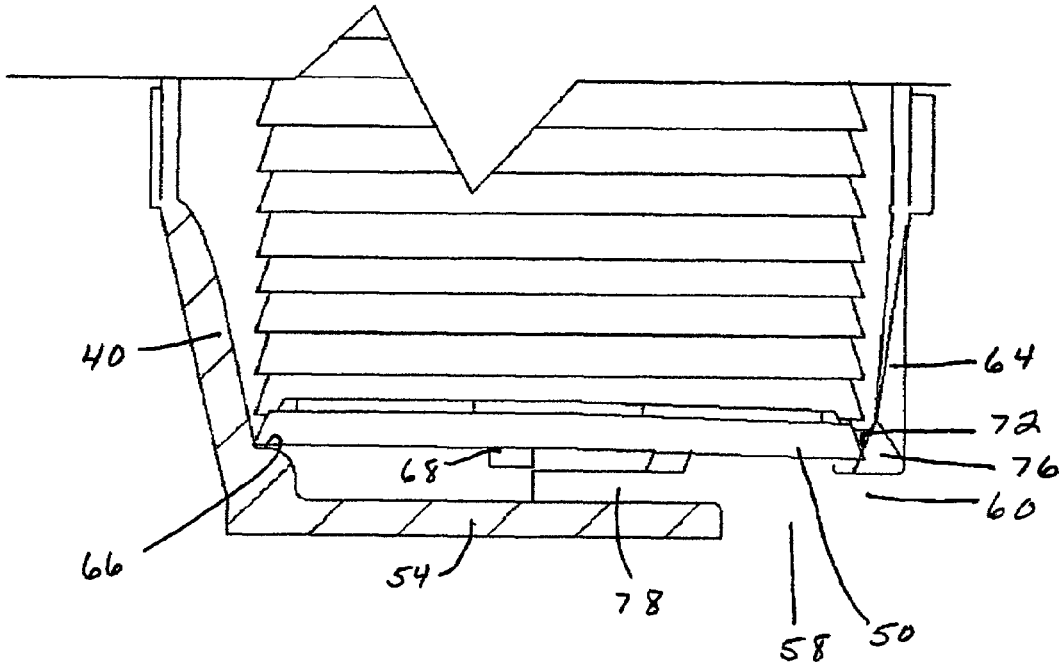
FIGS. 9A-9C are cross-sectional side elevation views of the lower end of the dispenser, illustrating the sequence of removal a single cup lid from the bottom of a stack of lids contained in the dispenser.
Figure 9B:
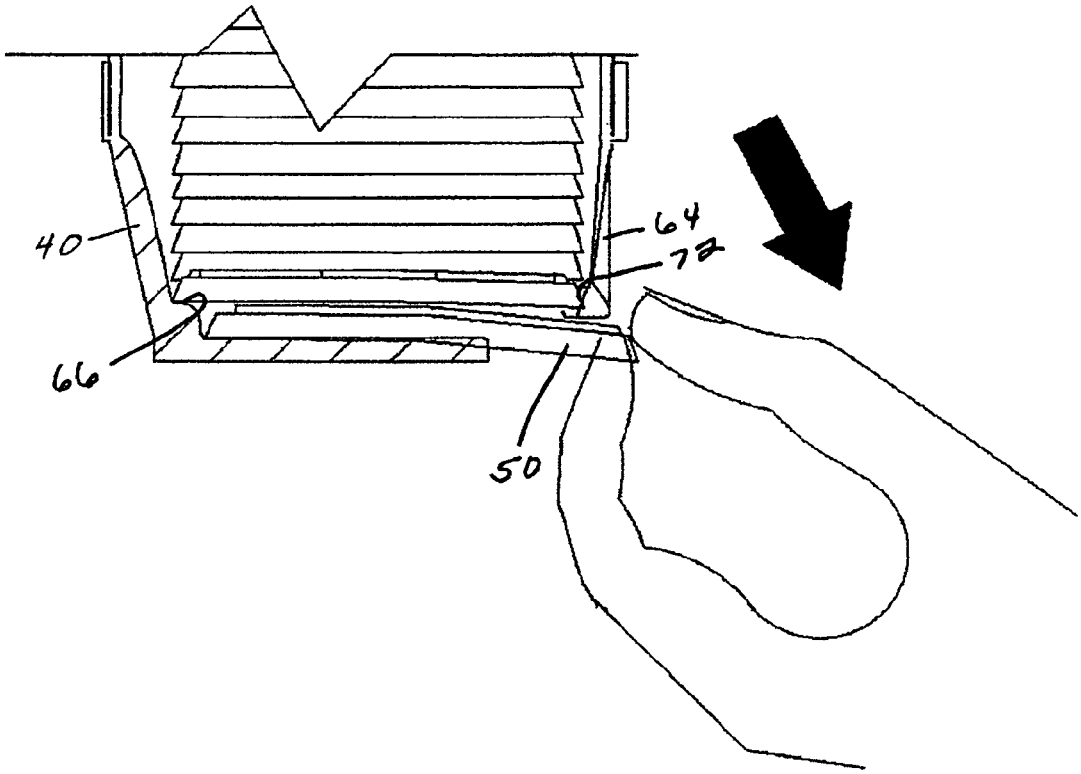
Figure 9C:
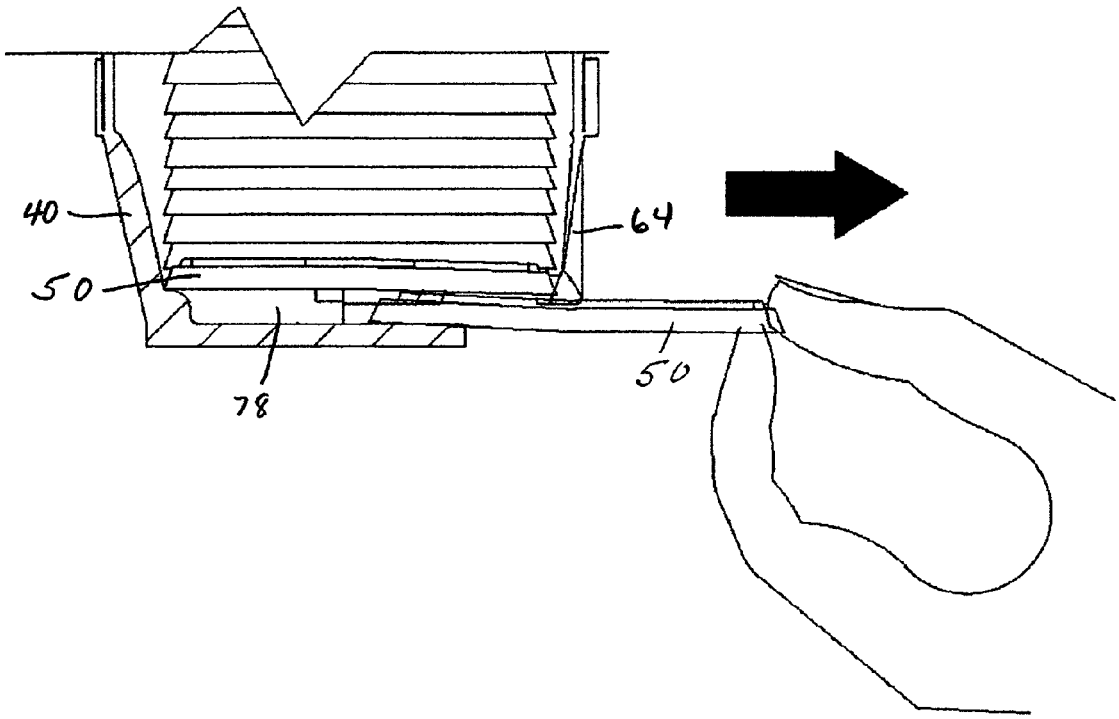

FIGS. 9A-C show the sequence of dispensing a lid 50 from the cup lid dispenser 20. As seen in FIG. 9A, with a stack of cup lids loaded into the dispenser 20 in bottom down orientation, the bottommost lid of the stack is supported by the shelves 66, 68 and 72 above and generally parallel to the bottom wall or protruding lip 54 of the base 40 and above the pocket 78. In this position, the bottommost cup lid is staged for being dispensed, with the finger guide 64 and the cup lid gripping opening 76 then exposing for gripping only the forward lip of only the lowermost lid, but none of the lips of any overlying lids.

To dispense the lowermost cup lid 50 and remove it from the dispenser 20, and with the finger guide 64 serving to properly orient an operator's index finger and thumb to grip the lip of the lid, as seen in FIG. 9B the lip of the bottommost lid, which it is exposed in the lip gripping opening 76, is gripped by the operator. The operator then pulls the lip downward and forward, which moves the lid downward off of the shelves 66, 68 and 72 and forward beneath the ribs 70 of the finger guide 64, causing it to fall downward and away from the overlying stack of lids and into the pocket area 78. To complete the dispense of the lid, and as seen in FIG. 9C, the operator continues to pull the lid forward through the cup lid dispensing opening 60, thereby removing the lid from the dispenser 20 for placement onto a cup. By virtue of only the bottom lid of the stack being exposed for gripping by an operator, and since during dispense the bottom lid falls into the pocket 78 and away from the overlying stack of lids, there is no tendency during dispense for the bottom lid to pull overlying lids along with it, whereby only the bottom lid is removed from the stack.

While the invention has been described in connection with mounting one or more cup lid dispensers 20 on a front surface of an ice and beverage dispenser, there are many other arrangements and environments in which the cup lid dispensers may advantageously be used. A user can customize individual ones of the dispensers to the size of lids to be dispensed, and can tailor the mounting arrangement of the dispensers to suit his individual needs and usage requirements. Various numbers of dispensers can be carried on the front of a beverage dispenser, for example from one to eight or more, and the lid dispensers can be provided at locations other than on beverage dispensers, for example in condiment areas of a restaurants, where they can be table top, countertop and wall mounted.

Figure 10:
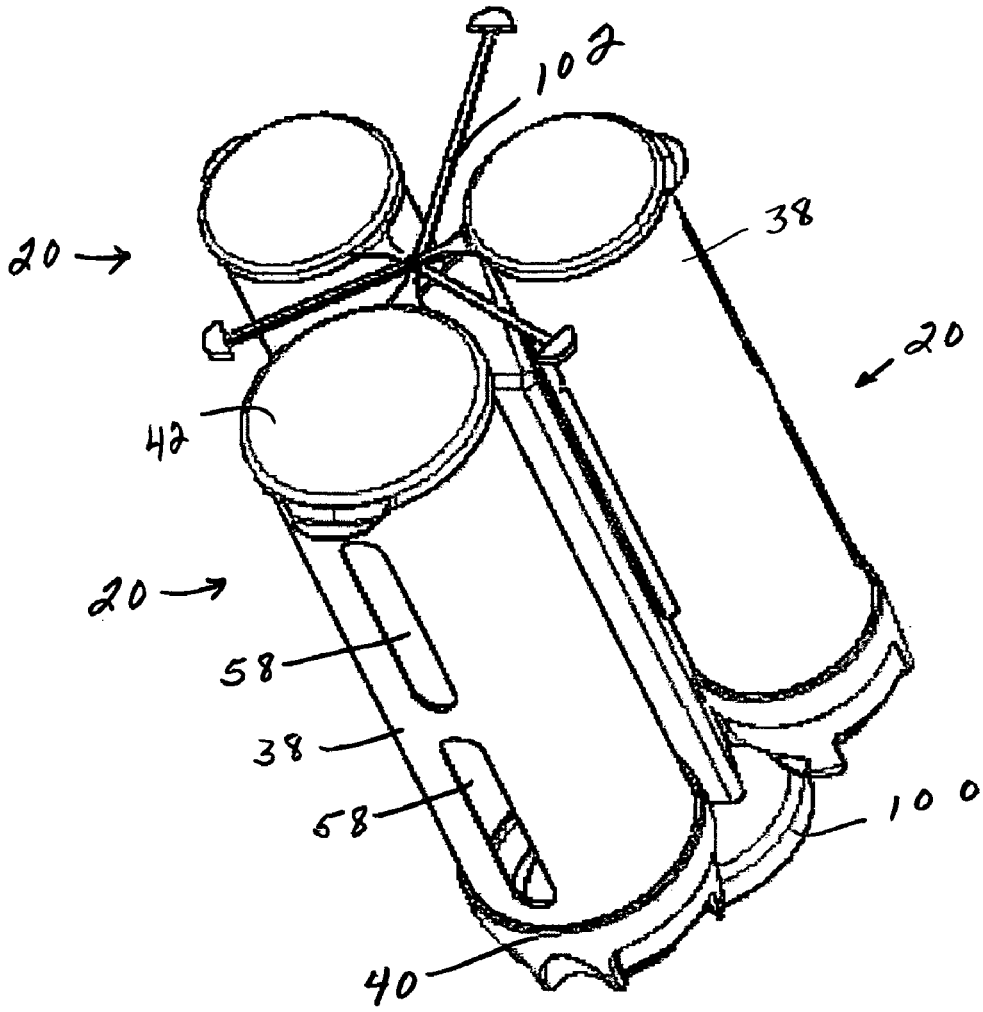
FIG. 10 is a perspective view of an assembly of three cup lid dispensers arranged for counter top mounting.
Figure 11:
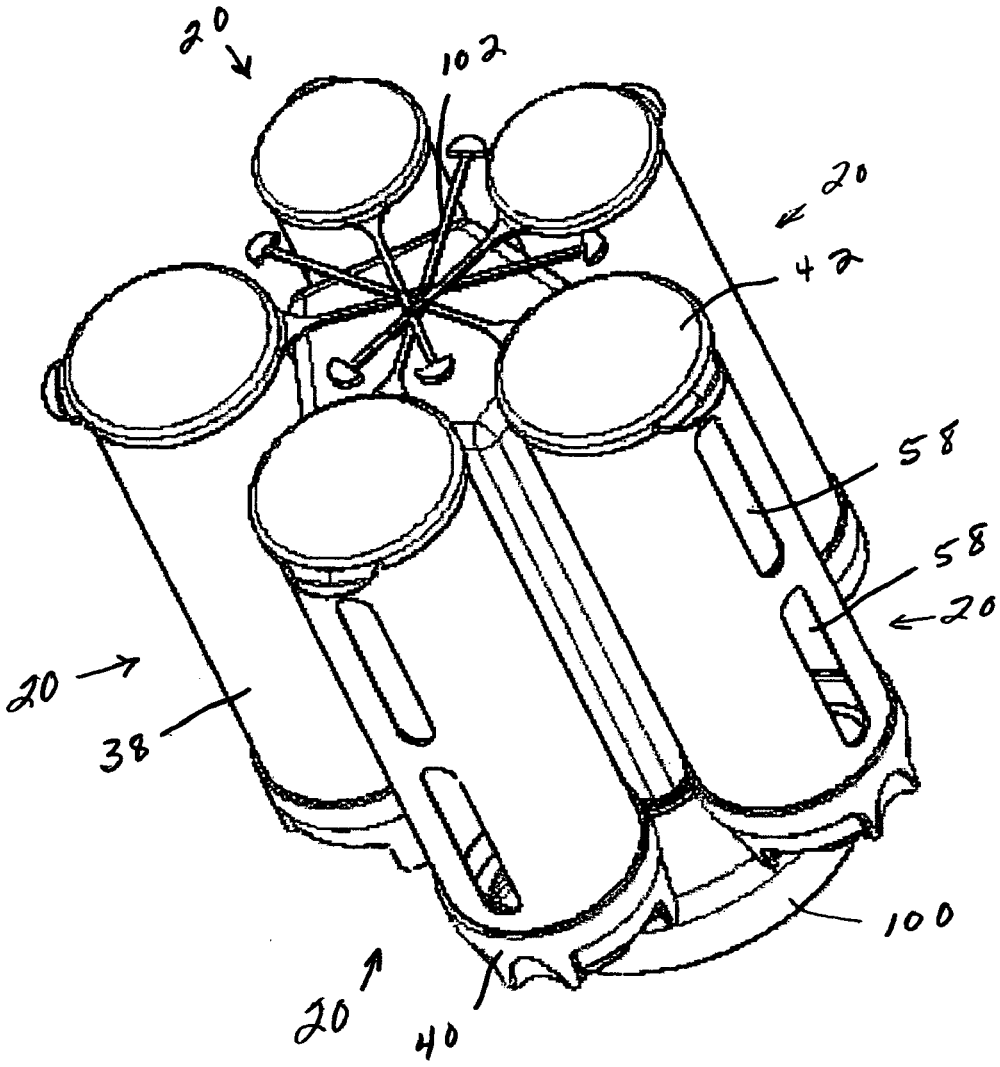
FIG. 11 is a perspective view of an assembly of five cup lid dispensers arranged for counter top mounting.

FIGS. 10 and 11 show two possible manners in which cup lid dispensers 20 of the invention can be used, other than by being mounted on a beverage dispenser. FIG. 10 shows an assembly of three cup lid dispensers 20 and FIG. 11 an assembly of five cup lid dispensers, in each of which assembly the lid dispensers may be individually sized to accommodate dispensing of different sizes of cup lids, such as lids for small, large and extra large beverage cups. In each assembly the lid dispensers 20 are supported at their lower ends on a rotatable base or turntable 100 that is adapted to be rotatably carried or mounted on a countertop or table top, and at their upper ends are connected together by a latticework 102. The countertop and table top mounting enables a user to rotate a lid dispenser assembly on the central base 100 until the individual dispenser containing the size of cup lid desired is in front of the user. Each individual dispenser of an assembly can be labeled to identify the size of lid it contains, although to provide visual feedback it is contemplated that the lid containment tubes 38 of the dispensers be made of transparent plastic. The lid dispenser assemblies can be used in the dining area of a restaurant, ensuring ease of use, high hygiene levels and a reduction in lid wastage.

Figure 12:
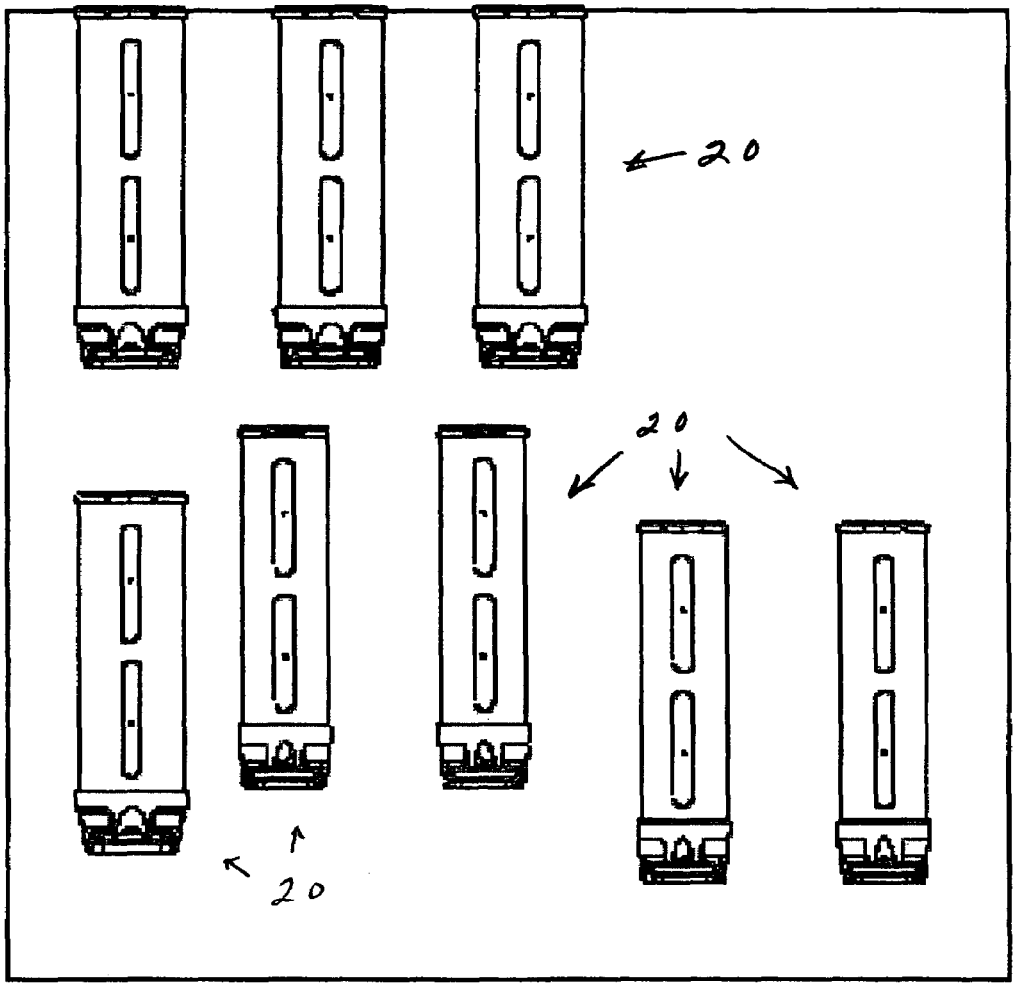
FIGS. 12 and 13 are elevation views of two possible wall mounting arrangements of a plurality of cup lid dispensers.
Figure 13:
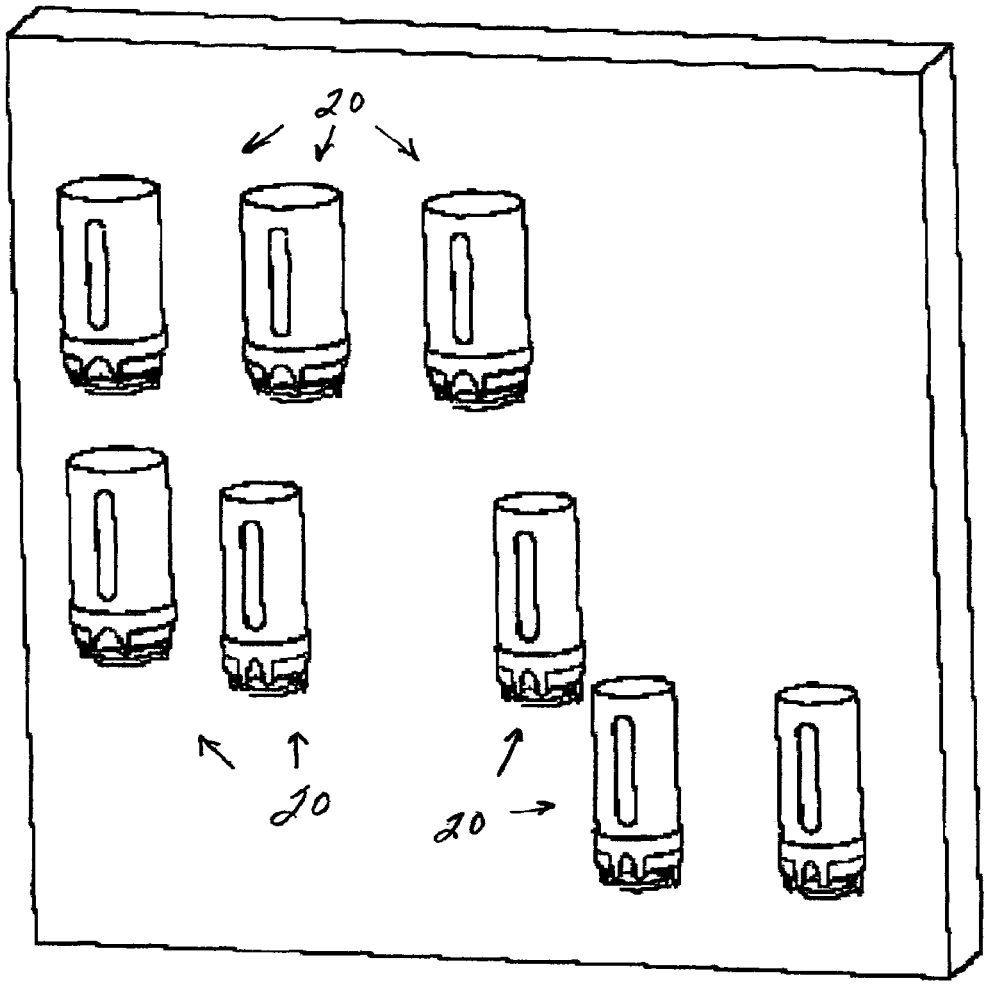

It also is contemplated that the lid dispensers 20 may be wall mounted, as shown in FIGS. 12 and 13. The dispensers can be wall mounted in any desired number and arrangement and sized as required, and they can be mounted at different heights to cater to all restaurant users.

Figure 14:
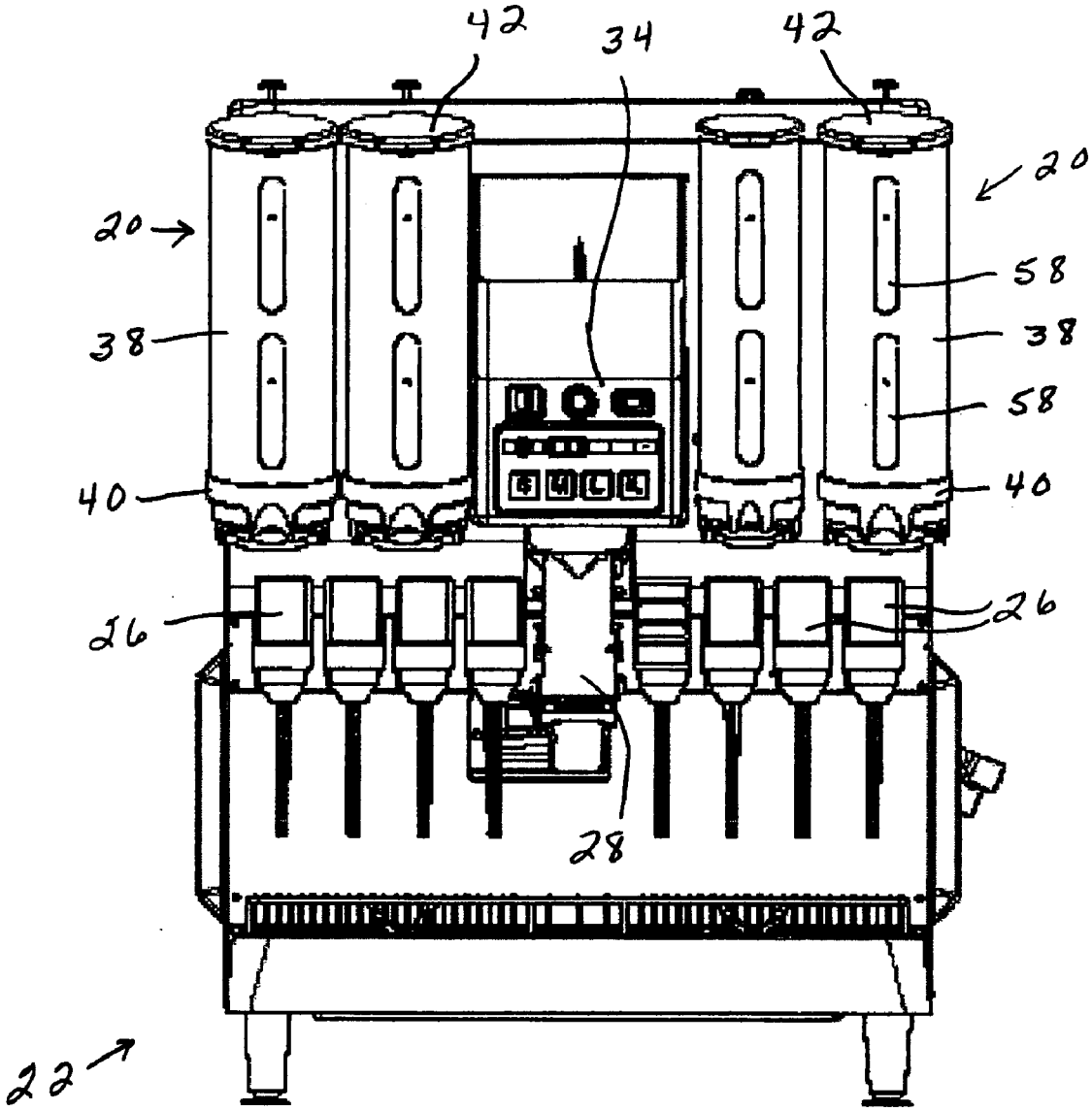
FIGS. 14 and 15 are front views of two possible arrangements of cup lid dispensers on a front surface of an ice and beverage dispenser.
Figure 15:
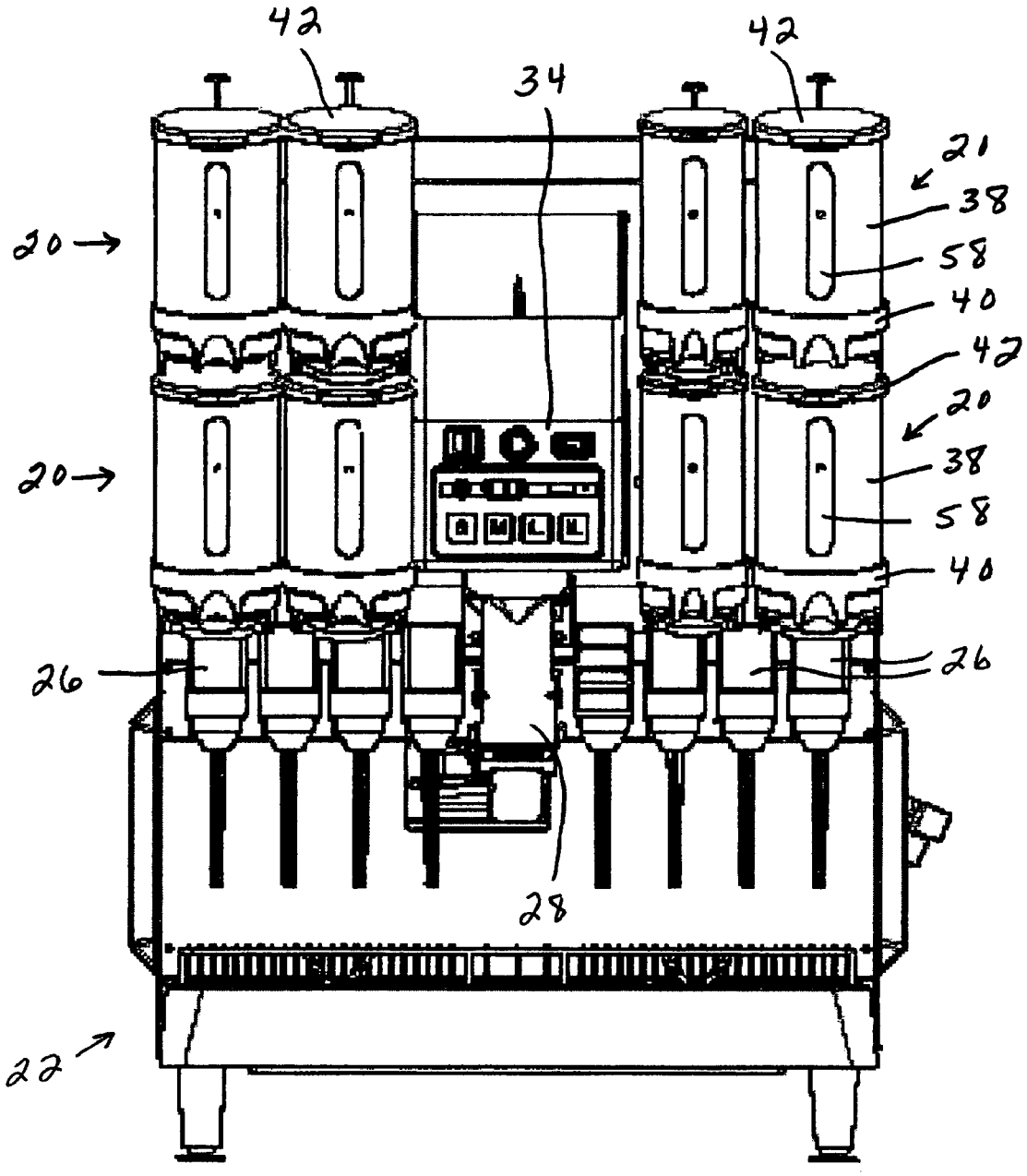

The lid dispensers 20 can be arranged in various desired manners, depending on the particular requirements of a user. For example, in stores where the majority of drinks dispensed from a beverage dispenser at a drive thru window are large size drinks, in mounting lid dispensers on the beverage dispenser, the store can have the option, as shown in FIG. 14, of having two large drink lid dispensers, one small/medium drink lid dispenser and one extra large drink lid dispenser be on the beverage dispensing machine. The four lid dispensers 20 can be removably mounted on the beverage dispenser in up to twelve different arrangements, as seen from FIG. 16, providing the user with considerable flexibility for dispensing beverages. Also, the vertical height of the lid dispensers can be varied, giving the user the ability to mount additional numbers of lid dispensers on a beverage dispenser, such as eight lid dispensers as shown in FIG. 15.

Figures 17A, 17B, 17C:
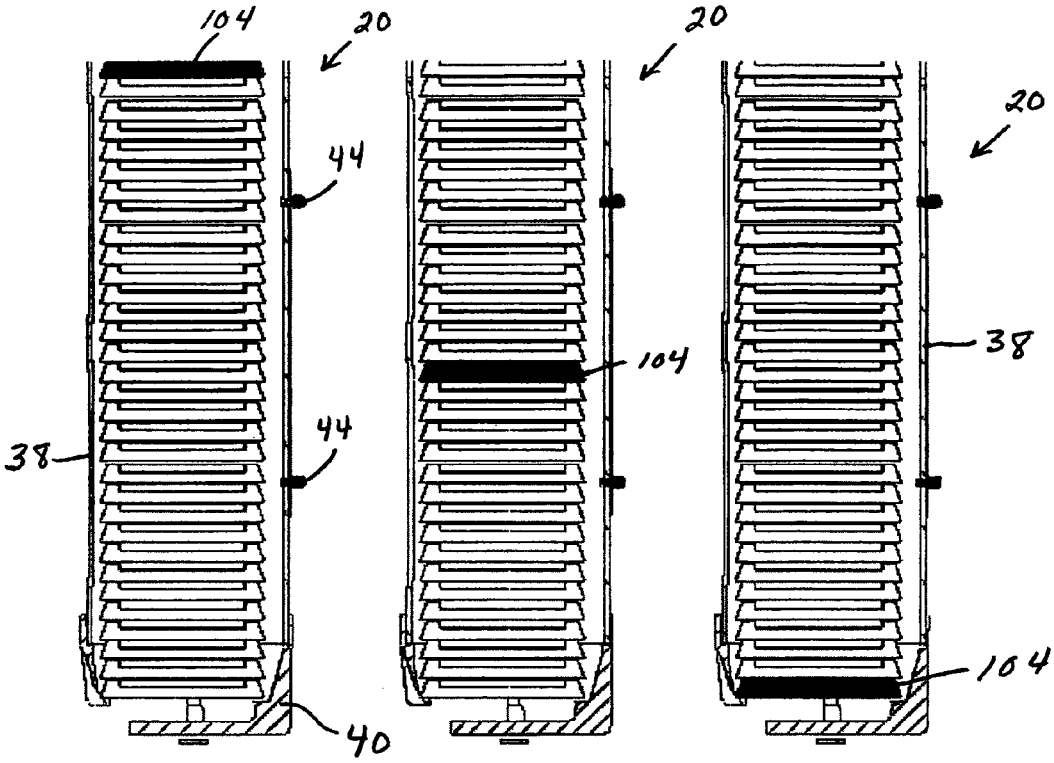
FIG. 17 illustrates movement of a cup lid from the top of a stack of lids in a dispenser to and for withdrawal from the bottom of the stack.

The manner in which the lid dispenser 20 is filled with lids, and lids are dispensed, ensures lid rotation and avoids "stagnation" of any lids in the dispenser. In particular, the design of the dispenser 20 provides for dispensing of lids on a first in, first out basis. The lid dispenser of the invention improves upon current lid dispensers that are designed to target the lids at the top of the lid pile for dispensing, which can result in lids toward the bottom of the stack not being used and remaining in the dispenser for a long period of time, during which they can become contaminated and unsanitary. Thus, with many conventional dispensers, lids at the top of the pile are dispensed at the expense of lids at the bottom of the pile, leading to sanitation issues and, ultimately, lid wastage through the necessity of lid disposal. The lid dispenser 20 of the invention, on the other hand, ensures that all lids are ultimately used in turn, such as the lid 104 as is shown in FIGS. 17A-C to move, as successive lids are dispensed, from the top of the stack of lids in the dispenser 20 to the bottom of the stack for its turn to be dispensed.

In addition to providing improved sanitation for the cup lids, the lid dispenser 20, since it can readily be removed from its mounting, can itself advantageously be sanitized by being placed and washed in a dishwasher.

While embodiments of the invention have been described in detail, various modifications and other embodiments thereof may be devised by one skilled in the art without departing from the spirit and scope of the invention, as defined in the appended claims.

What is claimed is:

1. A cup lid dispenser comprising:

a cup lid containment tube for holding a stack of cup lids; and a base at a lower end of said containment tube for receiving a lower end of a stack of lids in said containment tube, said base having a plurality of cup lid supports for supporting a circumferential periphery of a bottommost lid of the stack, a bottom wall extending from a rearward side of said base partially toward a forward side of said base and below and spaced from said supports and defining between said supports and said bottom wall a cup lid receiving pocket, a cup lid dispensing opening at a forward side of said base and opening to said cup lid receiving pocket, and a user guide at said forward side of said base for exposing a forward portion of just the bottommost lid of the stack for gripping by a user but blocking user access to lids of the stack above the bottommost lid, whereby a user can dispense the bottommost cup lid of the stack by gripping the exposed forward portion of the bottommost lid and pulling the lid downward off of said cup lid supports and into said lid receiving pocket and then forward through said cup lid dispensing opening and out of said cup lid dispenser, wherein said base bottom wall extends forward from a lower rearward side of said base, is joined to said base rearward side about an arcuate extent that is less than half the circumference of said base, extends in a plane generally perpendicular to a longitudinal axis of said containment tube, and extends forward from said base rearward side in a generally "bell curve" configuration toward, but short of, said base forward side to define a generally crescent-shaped opening from a bottom of said base.

2. A cup lid dispenser as in claim 1, wherein said cup lid dispensing opening at said forward side of said base is contiguous with said crescent-shaped opening from said bottom of said base and said two openings together define a cup lid outlet opening from said cup lid receiving pocket.

3. A cup lid dispenser as in claim 2, wherein said user guide comprises a downwardly extending portion of said base that terminates at its lowermost end at said cup lid dispensing opening and below the bottommost cup lid of the stack, said user guide having a medial upwardly extending arcuate opening that exposes just a forward portion of just the bottommost cup lid for gripping by a user, said user guide also having a portion for guiding one of a user's thumb and index finger to the exposed forward portion of the bottommost cup lid for gripping and removal of the bottommost cup lid from said dispenser.

4. A method of dispensing cup lids, comprising the steps of:

loading a stack of cup lids into a cup lid containment tube having a cup lid dispensing base at its lower end for receiving a lower end of the stack of cup lids;

supporting a circumferential lip of the bottommost cup lid of the stack on a plurality of supports within the base;

forming in the base a cup lid receiving pocket beneath the bottommost lid;

defining a cup lid dispensing opening at a forward side of the base as an extension of the cup lid receiving pocket;

exposing at the forward side of the base a forward portion of the lip of just the bottommost cup lid of the stack for gripping by a user; and removing the bottommost cup lid of the stack from the overlying cup lids by gripping the exposed forward portion of its lip, pulling the gripped bottommost cup lid downward off of the supports and into the cup lid receiving pocket, and then pulling the bottommost cup lid forward through the cup lid dispensing opening, wherein said exposing step comprises providing a generally vertically extending user guide at the forward side of the base, and configuring the user guide to expose just the forward portion of the lip of just the bottommost cup lid of the stack for gripping by a user and to guide one of a user's thumb and index finger to the exposed forward portion of the lip for being gripped by the user.

5. A method of dispensing cup lids, comprising the steps of:

loading a stack of cup lids into a cup lid containment tube having a cup lid dispensing base at its lower end for receiving a lower end of the stack of cup lids;

supporting a circumferential lip of the bottommost cup lid of the stack on a plurality of supports within the base;

forming in the base a cup lid receiving pocket beneath the bottommost lid;

defining a cup lid dispensing opening at a forward side of the base as an extension of the cup lid receiving pocket;

exposing at the forward side of the base a forward portion of the lip of just the bottommost cup lid of the stack for gripping by a user; and removing the bottommost cup lid of the stack from the overlying cup lids by gripping the exposed forward portion of its lip, pulling the gripped bottommost cup lid downward off of the supports and into the cup lid receiving pocket, and then pulling the bottommost cup lid forward through the cup lid dispensing opening, wherein said step of forming in the base a cup lid receiving pocket comprises the step of providing a bottom wall of the base that extends from a rearward side of the base partially toward the base forward side and spaced from and below the bottommost cup lid of the stack to define the cup lid receiving pocket between the supported bottommost lid of the stack and the bottom wall, and wherein said step of providing the bottom wall provides a bottom wall that extends forward from a lower rearward side of the base, is joined to the base rearward side about an arcuate extent that is less than half the circumference of the base, extends in a plane generally perpendicular to a longitudinal axis of the cup lid containment tube, and extends forward from its juncture with the base in a generally "bell curve" configuration toward, but short of, the base forward side to define a generally crescent-shaped opening from a bottom of the base.

6. A cup method as in claim 5, wherein said step of defining a cup lid dispensing opening defines the cup lid dispensing opening at the forward side of the base to be contiguous with the crescent-shaped opening from the bottom of said base, so that the two openings together define a cup lid outlet opening from the cup lid receiving pocket.

* * * * *